US005221437A

United States Patent [19]

Sieron et al.

[11] Patent Number: 5,221,437

[45] Date of Patent: Jun. 22, 1993

[54] SCREENING APPARATUS FOR PAPER MAKING STOCK

[75] Inventors: Michael A. Sieron, Centerville; Clinton R. Parks, Hamilton; Peter Seifert, Middletown, all of Ohio

[73] Assignee: The Black Clawson Company, Middletown, Ohio

[21] Appl. No.: 726,971

[22] Filed: Jul. 8, 1991

[51] Int. Cl.[5] ..... D21C 9/08

[52] U.S. Cl. ..... 162/232; 162/55; 162/380; 209/273

[58] Field of Search ..... 162/55, 380, 232; 209/273, 17

[56] References Cited

U.S. PATENT DOCUMENTS

| | | | |
|---|---|---|---|
| 3,174,622 | 3/1965 | Lamort | 209/273 |
| 3,437,204 | 4/1969 | Clarke-Pounder | 209/273 |
| 3,581,903 | 6/1971 | Holz | 210/415 |
| 4,166,028 | 8/1979 | Weber | 209/273 |
| 4,252,641 | 2/1981 | Martin | 209/273 |
| 4,991,720 | 2/1991 | Hoglund et al. | 209/273 |
| 5,009,774 | 4/1991 | LeBlanc | 209/273 |

FOREIGN PATENT DOCUMENTS 1471238 4/1977 United Kingdom .

OTHER PUBLICATIONS

"The Bird Pressure Knotter" Sep. 1980.

*Primary Examiner*—W. Gary Jones
*Assistant Examiner*—Brenda Lamb
*Attorney, Agent, or Firm*—Biebel & French

[57] ABSTRACT

Screening apparatus for separately removing knots and heavy reject particles from paper making stock comprises a generally cylindrical vertical housing having the interior thereof separated by a cylindrical perforated screening member into an annular screening chamber and an accepts space on the outer and inner sides of the screening cylinder respectively. Separate outlets for light and heavy reject particles are located at the top and bottom of the screening chamber, the supply flow of feed stock enters the screening chamber at the bottom thereof, and special provision is made to insure that maximum separation of the knots and other lighter reject particles from the heavy reject materials will be effected within the screening chamber with minimum contact with the screening cylinder itself.

11 Claims, 3 Drawing Sheets

10
12
36
16
14
40
3
50
52
53
55
11
19
44
15
62
61
30
35
17
60
13
12
10
33
20
18
23
34
25
26
27

SCREENING APPARATUS FOR PAPER MAKING STOCK

BACKGROUND OF THE INVENTION

Paper mills have for many years made extensive use, for the cleaning of paper making stock, of pressure screening apparatus embodying a cylindrical perforated screening member which defines screening and accepts chambers on the opposite sides thereof in a vertical housing, and wherein a rotor member operates in one of the chambers to keep the screening perforations open and free from solid material having a tendency to cling to the surface of the screening cylinder.

The assignee of this invention has manufactured and sold many such screens in accordance with a series of U.S. patents, commencing with Staege U.S. Pat. No. 2,347,716, and followed by Martindale U.S. Pat. No. 2,835,173 and numerous other patents including Seifert U.S. Pat. No. 3,849,302 and 4,105,543. In operation, the stock or furnish is delivered to the screening chamber adjacent one end of the screening cylinder, and the material rejected by the screening cylinder is collated and discharged from the opposite end of the screening chamber.

None of these types of screening apparatus have proved to be entirely satisfactory for screening stock which includes both heavy reject materials and also relatively large particles of reject materials whose specific gravities are essentially the same as or slightly less than water. The primary example of feed stock presenting this type of problem is wood pulp stock as it comes from a digester and therefore contains not only substantial quantities of pebbles and tramp metal, but also substantial quantities of knots whose specific gravity is close to that of water because they are impregnated with liquor absorbed during the digesting process.

If stock of this nature is treated in screening apparatus as outlined above wherein the screening chamber is inside the screening cylinder, the knots are likely to remain in the screening chamber for a substantial period and can effect considerable abrasion of the inner surface of the cylinder. The same is true to a lesser extent when the screening chamber is outside the screening cylinder, but it is still a problem to induce all of the knots to exit with the heavy reject materials from a reject outlet at the lower end of the screening chamber. Another problem is that in either of these cases, if the knots and heavy reject material are removed by way of the same reject outlet, a further operation is needed if it is desired to separate the heavy knots from the heavy reject for further processing in order to recover usable fiber therefrom.

SUMMARY OF THE INVENTION

The present invention has as its primary object the provision of screening apparatus for paper making stock containing relatively uncomminuted reject materials such as knots and also heavy reject particles such as pebbles and pieces of metal wherein the heavy and light contaminant particles are separated within the screening chamber and removed by way of separate reject outlets.

In a preferred embodiment of the invention, the screening chamber is an annular chamber positioned between a screening cylinder and the outer housing wall, separate outlets for light and heavy reject particles are located at the top and bottom of the screening chamber, and the supply flow to the screening chamber is controlled to assure that maximum separation of the knots and other lighter reject particles from the heavy reject particles will be effected within the screening chamber with minimum contact with the screening cylinder itself.

Other and more specific objects and advantages of the invention will be pointed out in or apparent from the detailed description which follows of a preferred embodiment of the invention.

DESCRIPTION OF THE PREFERRED EMBODIMENT

Figures 1, 2:
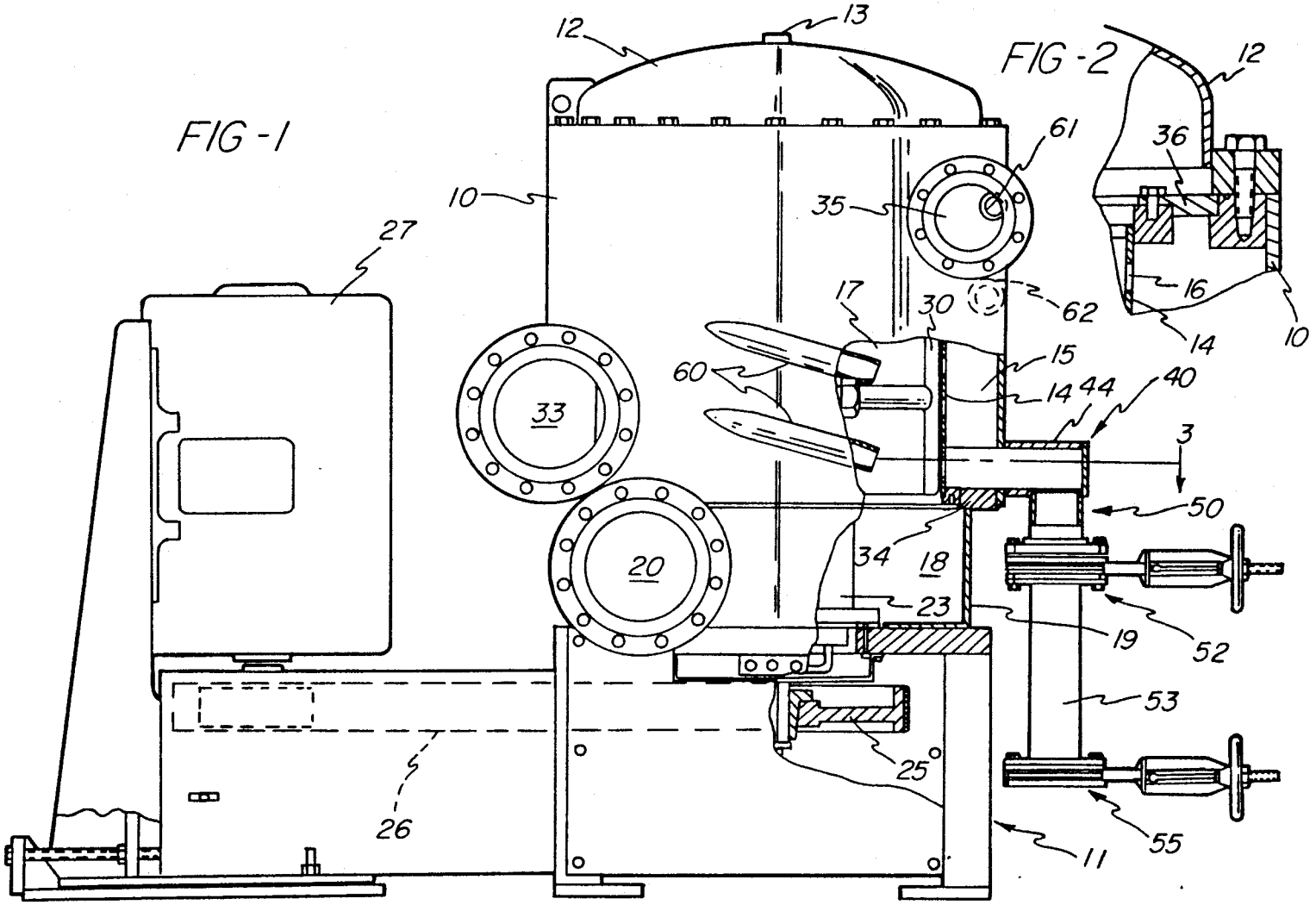
FIG. 1 is a side elevation, partly broken away in vertical section, showing screening apparatus in accordance with the invention.
FIG. 2 is an enlarged fragment of FIG. 1 broken away in generally vertical section.

The screening apparatus shown in the drawings comprises a main housing 10 of cylindrical section mounted with its axis vertical on a base 11 and provided with a domed top cover 12 having an air bleed 13. A perforate screening cylinder 14 cooperates with the housing 10 to define an annular screening chamber 15 between the outside of cylinder 14 and housing 10. The screening cylinder 14 may be provided with perforations 16 of any conventional shape, size and spacing, and stock which has passed through these perforations enters first an accepts space 17 inside the cylinder 14 and then flows downwardly into an accepts chamber 18 having an outer wall 19 which is a part of the supporting structure for housing 10 on base 11. The outlet port 20 for accepted stock leads from chamber 18 through wall 19.

Within the accepts space 17 on the inside of screening cylinder 14 is a rotor assembly 22 secured on the upper end of a drive assembly 23 which is supported on the base 11 and includes a pulley 25 on its lower end having a driving belt connection 26 to a drive pulley on the shaft of a motor 27. The rotor assembly 22 includes four angularly spaced vanes 30 which are supported in closely spaced relation with the inner surface of the screening cylinder 14 and operate to create alternate positive and negative pressure pulses effective on the perforations in cylinder 14 to keep those perforations from becoming covered or clogged by solid materials in the screening chamber 15.

The feed stock to be screened, which contains knots as well as heavy reject particles, is delivered to the screening chamber 15 by a tangentially arranged inlet port 33 located close to the annular plate 34 that forms the bottom wall of the screening chamber 15. As previously noted, while a relatively small portion of the knots in the feed stock normally will be light enough to float, the majority are heavier because they have absorbed substantial quantities of liquid during the digestion process and therefore have specific gravities substantially matching that of the liquid in which they are suspended. Special provision is made in accordance with the invention for separating the knots from the heavy reject material within the screening chamber 15 and removing them by separate outlets.

The outlet for knots and other light reject materials comprises a port 35 extending tangentially from the screening chamber 15 in the opposite direction from the inlet port 33. Preferably the port 35 is located as close as possible to the clamp ring 36 at the top of screening cylinder 14 which closes the top of the screening chamber 15.

The separate outlet assembly for heavy reject materials comprises a radially projecting extension 40 of the screening chamber 15 which includes a bottom wall 41 aligned with the bottom wall 34 of screening chamber 15, side walls 42 and 43, and a top wall 44. The side walls 42 and 43 extend tangentially from the opposite ends of a slot 45 near the bottom end of housing 10 and converge at an included angle of 90° to a cylindrically curved wall portion 46 which connects their outer ends.

The bottom wall 41 is provided with a circular hole or port 47 which is concentric with and of substantially the same radius as the curved wall portion 46, and which leads to a reject trap assembly 50 depending from the bottom wall 41 to receive and retain heavy reject particles which fall through the outlet port 47. More specifically, a short length of pipe 51 is directly connected with the port 47 at its upper end, and its lower end is connected through a valve assembly 52 with a second length of pipe or boot 53 which forms a boot having a valve assembly 55 at its lower end. In normal operation, after a quantity of heavy reject materials has been accumulated in the boot 53, the valve 52 is closed and the valve 55 then opened to empty the boot.

When the screen is in operation, the stock as it is initially delivered tangentially to the screening chamber 15 will circulate therein, in clockwise direction as viewed from the top, and since the inlet port 33 is at the bottom of the chamber, the initial circulation pattern will be around the bottom of the chamber 15. Gravity and centrifugal force will cause the reject materials which have specific gravities greater than that of water to travel on bottom wall 34 and along the surface of housing 10 until they reach the extension chamber 40, and since they will continue to travel on the bottom wall 41 and side wall 42, when they reach the curved wall portion 46, they will drop through the port 47 into the trap assembly 50.

Those knots which have absorbed so much liquid as to have approximately the same specific gravity as the liquid will initially tend to follow the same travel pattern. However, since they are not heavier than the liquid, they will tend to remain above the level of the reject port 47 and be carried past it as they travel along the curved wall 46 and the other side wall 42 of the extension chamber 40 back into the screening chamber 15.

As the knots continue to circulate around the screening chamber 15, they will also continue to rise within chamber 15 until they ultimately reach the level of the top reject outlet port 35 and are discharged therethrough. This rising pattern of movement is promoted in part by the continuous supply of fresh feed stock to the bottom of chamber 15, and it is also promoted by providing one or more inlet pipes 60 for dilution liquid which are mounted on the outside of housing 10 in inclined relation to the horizontal so that they deliver dilution liquid to the chamber 15 in an upward direction which will provide an additional component of upward movement for knots whose specific gravities are close to that of the liquid.

Discharge of such reject materials through the outlet port 35 is also promoted by a similar pipe 61 for dilution liquid mounted in aligned relation with the port 35 but extending in the opposite direction from the housing 10 so that it will discharge dilution liquid directly into the inlet end of the port 35. A similar dilution liquid pipe 62 is mounted just below the level of the outlet port 35 and parallel with the pipe 61.

Figure 3:
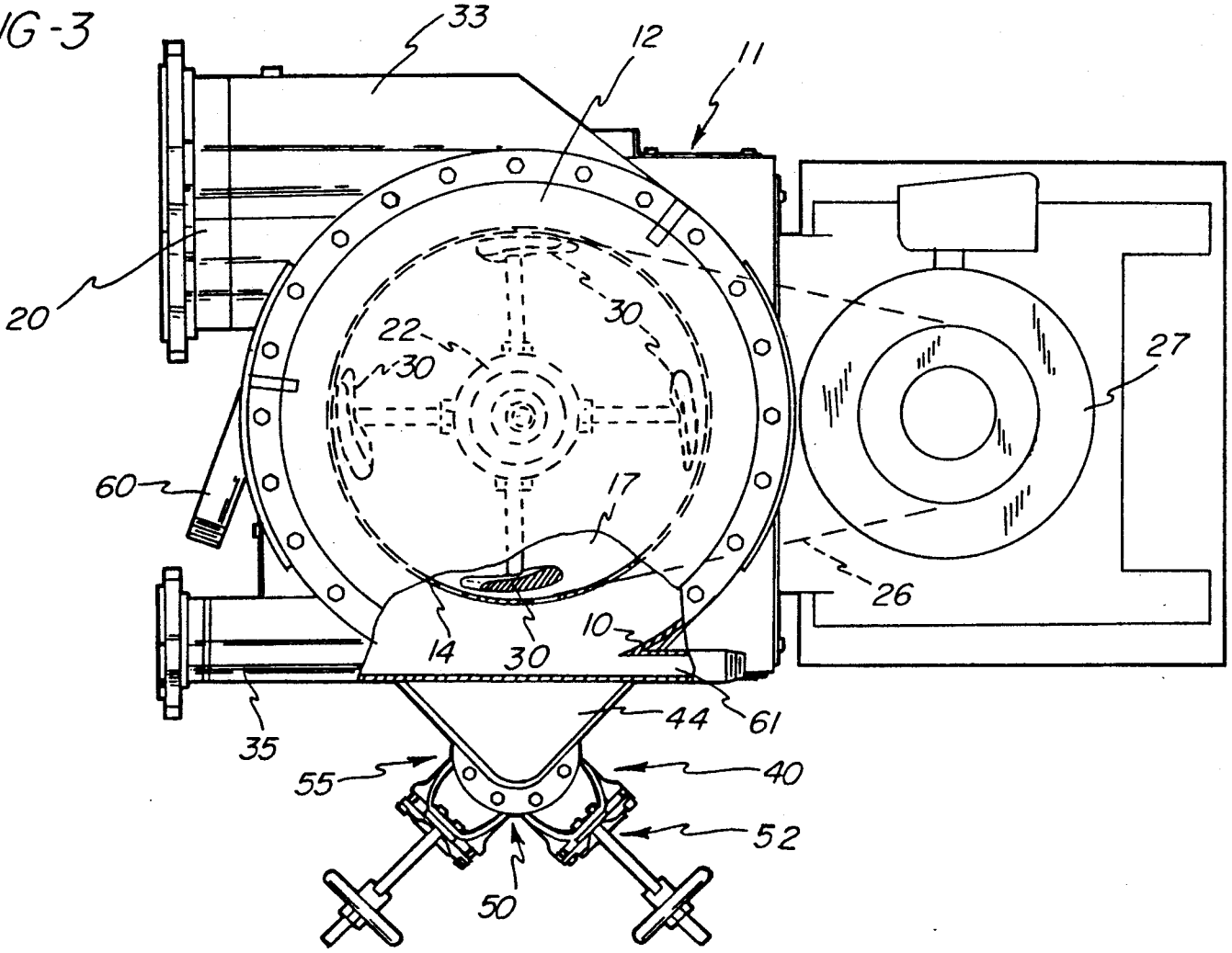
FIG. 3 is a plan view, partly broken away, of the screening apparatus shown in FIG. 1.
Figure 4:
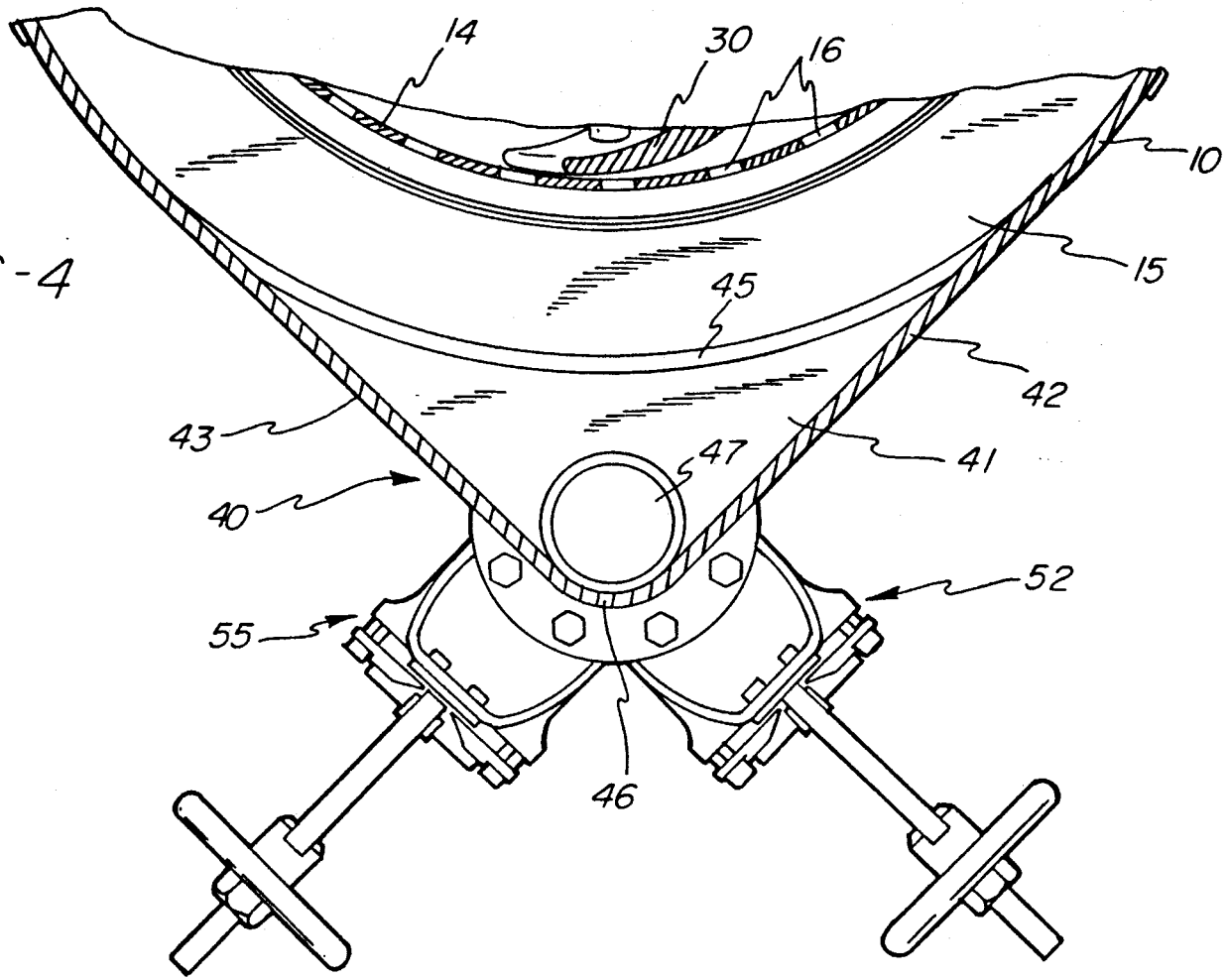
FIG. 4 is an enlarged fragmentary view taken in section on the line 3—3 in FIG. 1.

Stock containing knots will usually not contain light reject materials, such as the bits of plastic foam which are common in waste paper stock, and which are too large to pass through the perforations in the screening cylinder 14. Any such light reject which may be present, however, will circulate around the screening chamber 15 until they reach the level of the outlet 35 and are discharged therethrough along with the knots. It is also important to note that for optimum operating conditions, the rotor assembly 22 should rotate in the opposite direction from the stock circulating in chamber 15, as indicated by the arrow 65 in FIG. 3, so that reject particle which is forced out of a perforation 16 by a pressure pulse from a vane 30 will be carried by the current in the opposite direction from the vane and will be free to rise in chamber 15.

While the form of apparatus herein described constitutes a preferred embodiment of the invention, it is to be understood that the invention is not limited to this precise form of apparatus and that changes may be made therein without departing from the scope of the invention which is defined in the appended claims.

What is claimed is:

1. Screening apparatus for receiving paper making stock containing knits and heavy reject particles, and for separating said stock into three fractions consisting essentially of, respectively, heavy reject particles, knits and accepts, comprising:

(a) a generally cylindrical vertical housing, (b) a cylindrical perforated screening member supported within said housing and separating the interior of said housing into an annular screening chamber and an accepts space located respectively on the outer and inner sides of said screening member, (c) rotor means mounted for rotation in said accepts space and including a hub having vane means mounted thereon in angularly spaced relation with each other and in closely spaced relation with the inner surface of said screening member, (d) means for driving said rotor means to maintain the perforations in said screening member open, (e) said screening chamber having an annular bottom wall extending between said housing and the lower end of said screening member, (f) means including an inlet port entering said screening chamber substantially tangentially at a level adjacent said bottom wall, whereby all of said stock to be screened is delivered to the lower end of said screening chamber, (g) means defining an accepts outlet port from said accepts space, (h) said housing including portions extending laterally outwardly and forming side walls of a laterally outwardly projecting extension of said screening chamber, (i) said chamber extension having a bottom wall substantially aligned with and forming an extension of said bottom wall of said screening chamber, (j) said chamber extension being in open communication with said screening chamber whereby heavy reject particles entering said screening chamber through said inlet port will be carried by centrifugal force into said chamber extension along said bottom walls, (k) trap means depending from said bottom wall of said chamber extension into which heavy reject particles are carried by gravity from said chamber extension, and (l) means defining a reject outlet port leading from said screening chamber and located adjacent the top thereof to receive knots which rise to the top of the liquid in said screening chamber.

2. Screening apparatus as defined in claim 1 wherein said reject outlet port leads tangentially from said screening chamber in the opposite direction from said inlet port.

3. Screening apparatus as defined in claim 1 wherein said side walls of said chamber extension toward each other from said housing at a sufficiently large included angle that knots entering said chamber extension will return to said screening chamber rather than descending into said trap means.

4. Screening apparatus as defined in claim 3 wherein said angle is substantially 90°.

5. Screening apparatus as defined in claim 3 wherein said side walls are joined at the outer end of said chamber extension by a cylindrically curved outer end wall to facilitate the passage of knots through said chamber extension back to said screening chamber.

6. Screening apparatus as defined in claim 5 wherein said trap means includes a cylindrical pipe concentric with and of substantially the same inner radius as said cylindrically curved wall.

7. Screening apparatus as defined in claim 1 wherein said driving means is connected to rotate said rotor in the opposite direction from the flow of stock through said inlet port.

8. Screening apparatus as defined in claim 1 further comprising at least one pipe connected with said screening chamber through said housing to supply dilution liquid to said screening chamber.

9. Screening apparatus as defined in claim 8 comprising a plurality of said pipes and further wherein at least one of said pipes is inclined from the horizontal to deliver dilution liquid to said screening chamber in an upward direction tending to urge knots upwardly to the level of said reject outlet port.

10. Screening apparatus as defined in claim 8 comprising a plurality of said pipes and further comprising said reject outlet port leads tangentially from said screening chamber in the opposite direction from said inlet port, and one of said pipes is aligned with and extends from said screening chamber tangentially in the opposite direction from said reject outlet port to deliver dilution liquid directly toward said reject outlet port.

11. Screening apparatus as defined in claim 9 further comprising said reject outlet port leads tangentially from said screening chamber in the opposite direction from said inlet port, and one of said pipes is aligned with and extends from said screening chamber tangentially in the opposite direction from said reject outlet port to deliver dilution liquid directly toward said reject outlet port.

* * * * *

UNITED STATES PATENT AND TRADEMARK OFFICE

CERTIFICATE OF CORRECTION

PATENT NO. : 5,221,437

DATED : June 22, 1993

INVENTOR(S) : Michael A. Sieron, Clinton R. Parks, Peter Seifert

It is certified that error appears in the above-identified patent and that said Letters Patent is hereby corrected as shown below:

In the claim:

Column 5, line 20:

Claim 3, line 2, before "toward" insert -- converge --.

Signed and Sealed this

Eighteenth Day of January, 1994

*Attest:*

Bruce Lehman

BRUCE LEHMAN

*Attesting Officer*

*Commissioner of Patents and Trademarks*